US009544696B2

(12) United States Patent
Poupyrev et al.

(10) Patent No.: US 9,544,696 B2
(45) Date of Patent: Jan. 10, 2017

(54) FLEXIBLE, SHAPEABLE FREE-FORM ELECTROSTATIC SPEAKERS

(71) Applicant: Disney Enterprises, Inc., Burbank, CA (US)

(72) Inventors: Ivan Poupyrev, Pittsburgh, PA (US); Yoshio Ishiguro, Pittsburgh, PA (US)

(73) Assignee: Disney Enterprises, Inc., Burbank, CA (US)

( * ) Notice: Subject to any disclaimer, the term of this patent is extended or adjusted under 35 U.S.C. 154(b) by 208 days.

(21) Appl. No.: 14/138,484

(22) Filed: Dec. 23, 2013

(65) Prior Publication Data

US 2015/0181350 A1 Jun. 25, 2015

(51) Int. Cl.

| | |
|---|---|
| ***H04R 19/02*** | (2006.01) |
| ***H04R 19/01*** | (2006.01) |
| ***H04R 19/00*** | (2006.01) |
| ***H04R 31/00*** | (2006.01) |
| ***B06B 1/02*** | (2006.01) |
| *H04R 1/02* | (2006.01) |

(52) U.S. Cl.

CPC ..... *H04R 19/02* (2013.01); *B06B 1/0292* (2013.01); *H04R 19/005* (2013.01); *H04R 31/00* (2013.01); *H04R 1/028* (2013.01); *H04R 19/013* (2013.01); *H04R 2400/03* (2013.01)

(58) Field of Classification Search

CPC ..... H04R 19/00; H04R 19/01; H04R 19/02; H04R 19/005; H04R 19/013; B29C 67/0051; B33Y 80/00

See application file for complete search history.

(56) References Cited

U.S. PATENT DOCUMENTS

2014/0140551 A1* 5/2014 Ramstein ..... H04R 17/005 381/182

* cited by examiner

*Primary Examiner* — Matthew Eason
(74) *Attorney, Agent, or Firm* — Ference & Associates LLC

(57) ABSTRACT

An embodiment provides a free-form electrostatic speaker, including: a three dimensional object body; at least a portion of the three dimensional object body having a free-form electrode layer disposed thereon; the free-form electrode layer being shaped to substantially match the at least a portion of the three dimensional object body; a free-form diaphragm positioned proximate to, and being shaped to substantially match, the free-form electrode layer; and an input element coupled to the free-form electrode layer that accepts input from an external source. Other embodiments are described and claimed.

11 Claims, 15 Drawing Sheets

FLEXIBLE, SHAPEABLE FREE-FORM ELECTROSTATIC SPEAKERS

BACKGROUND

A loudspeaker is one of the most basic and key output devices in any interactive system. It is a transducer that converts an input electrical signal into an audible acoustic signal. The most common approaches to designing speakers are electromagnetic and piezoelectric speakers, and both approaches have a number of important limitations.

Electromagnetic speakers include a voice coil and a magnet, and the sound is generated by the vibrations of the paper cone induced by moving the magnet. Electromagnetic speakers are relatively large and consist of multiple materials and moving parts. The shape of the electromagnetic speaker is usually limited to a classic cone or its variations. Although mass-produced speakers are relatively cheap, designing and producing custom speakers is an order of magnitude more expensive and requires significant engineering efforts.

Piezoelectric speakers usually consist of two electrodes with a thin piezoelectric element (PZT), such as lead zirconate titanate, sandwiched in between. As a signal is applied to the electrodes the PZT element bends, creating audible vibration. Although piezoelectric speakers are simple and inexpensive, they are produced by baking piezoelectric paste at very high temperatures, and therefore it is difficult and expensive to produce them in anything other than a flat shape, particularly in small quantities. Increasing the size of the PZT elements is particularly challenging because their response rapidly decreases with increased size and thickness. Another important property of PZT speakers is that they are capable of creating ultrasonic sound sources and they are commonly used in sensor design.

A less commonly used technology for sound production is electrostatic loudspeaker technology (ESL), which had been intensively investigated in the early 1930s through the 1950s.

BRIEF SUMMARY

In summary, one embodiment provides a free-form electrostatic speaker, comprising: a three dimensional object body; at least a portion of the three dimensional object body having a free-form electrode layer disposed thereon; the free-form electrode layer being shaped to substantially match the at least a portion of the three dimensional object body; a free-form diaphragm positioned proximate to, and being shaped to substantially match, the free-form electrode layer; and at least one input element coupled to the free-form electrode layer that accepts input from an external source.

Another embodiment provides a free-form electrostatic speaker, comprising: a three dimensional object body having a conductive layer disposed on at least a portion thereof; a three dimensional printed diaphragm having a conductive layer disposed on at least a portion thereof; the three dimensional printed diaphragm having an insulating layer disposed on the conductive layer; a connecting element fixing the three dimensional printed diaphragm with respect to the conductive layer disposed on at least a portion of the three dimensional object body; and an input element coupled to the conductive layer of the three dimensional object body that accepts input from an external source.

A further embodiment provides a method of forming a free-form electrostatic speaker, comprising: printing a three dimensional object using a three dimensional printer; the three dimensional object having a conductive layer disposed on at least a portion thereof; printing a three dimensional diaphragm using a three dimensional printer; the three dimensional diaphragm having a conductive layer disposed on at least a portion thereof; the three dimensional diaphragm having an insulating layer disposed on the conductive layer; fixing the three dimensional diaphragm with respect to the conductive layer disposed on at least a portion of the three dimensional object body using a connecting element; and coupling at least one input element to the conductive layer of the three dimensional object body that accepts input from an external source.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1A:
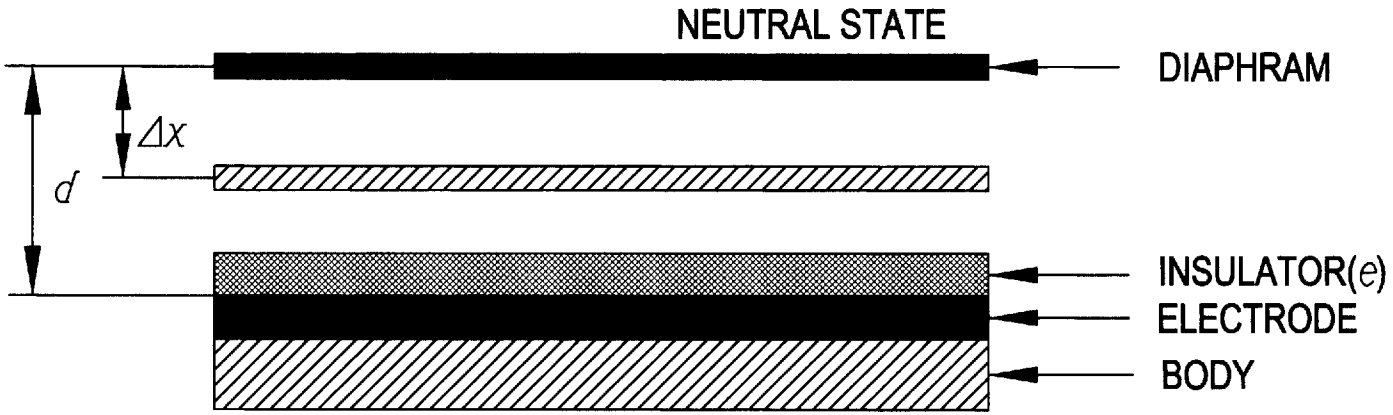
FIG. 1A illustrates basic operating principles of an electrostatic speaker.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Classic speaker technologies, as opposed to electrostatic loudspeaker (ESL) technology, by the very nature of sound production place significant constraints on their form factors, thus placing limitations on their applications. It is relatively difficult and expensive, for example, to create omni-directional speakers that produce sound equally in all directions. There have been many efforts to overcome the form factor limitations and produce alternative speaker designs. Film speakers, for example, can be very thin, relatively flexible and transparent, and they are usually based on piezoelectric crystal and electro-active polymers vibrating sheets of films. Stretchable speakers use silicon substrates and ionic conductors. Cylindrical speakers allow for the creation of omni-directional sound reproduction either by using PZT tubes or transducer arrays placed on cylindrical or spherical surfaces.

ESL technology provides speakers having almost no moving parts and can be made out of common materials. Electrostatic speakers may be very inexpensive and do not require complex assembly or involved production processes, in fact, they can easily be made at home by hand and can take virtually any geometrical shape. The ESL technology forms a basic foundation of the free-form electrostatic speakers described herein.

An embodiment provides free-form electrostatic speakers (speaker and loudspeaker are used interchangeably herein). The electrostatic speakers are free-form in that they may be fit to virtually any three-dimensional shape and are not limited to planar formats. Moreover, various components of the free-form electrostatic speakers, e.g., diaphragm, are flexible and may be shaped. Using the techniques described herein, almost any object, e.g., a three dimensional (3D) printed object, may be used as an electrostatic speaker. Specific, non-limiting example embodiments are described throughout with reference to 3D printed component(s). However, as with other components, other techniques may be utilized to form the speaker components, as will be appreciated by those having ordinary skill in the art.

For example, a 3D object formed using essentially any process may be used to create the speakers described herein. By way of non-limiting example and in addition to the various examples referencing 3D printed objects, other 3D shaped freeform objects, e.g., soft objects, may be used. For example, a sound reproducible paper with thin aluminum foil, cushion and cloth may be used to form a speaker, e.g., by using two layered electro-conductive cloth (however formed). A cushion speaker for example may include two electro-conductive cloth pieces that are divided by an insulation cloth piece and having urethane padding therein. Thus, while many example embodiments are described using objects that have been 3D "printed", other objects, including body components, may be utilized and 3D printing is but one example case of building a 3D freeform speaker.

In an embodiment, the production of the free-form electrostatic speakers is based on principles of electrostatic sound reproduction (ESR), which were investigated in depth as early as the 1930s but have not been commonly used except in high performance and high-end audio systems. However, there is a natural fit between 3D printing technology and ESR speaker design. Because of the nature of ESR, it allows fabrication of free-form speakers that are seamlessly integrated into the physical objects of virtually arbitrary geometries, including even spherical and omni-directional shapes.

In addition, free form electrostatic speakers can effectively produce both audible and ultrasound frequencies and therefore can provide interactivity, e.g., tracking and object identification applications, in addition to sound reproduction functionality. Experimental evaluation has demonstrated that the free-form electrostatic speakers described herein produced high quality sound at 60 dB levels.

3D Printed Speakers

In the last two decades, there has been rapid growth in the application of print-based techniques to the manufacturing of a broad variety of devices, including printing circuits using electro-conductive inks, printing transistors, microprocessors and even displays, designing hybrid systems that combine direct printing with other manufacturing technologies, such as stereo-lithography. At the same time, free-form 3D printing techniques based on additive fabrication techniques have been used to create both passive objects as well as integrated functional devices, such as actuators, relays, batteries and other items.

There have been growing efforts to develop new materials and processes to 3D print objects that integrate multiple properties and functionalities. The goal here has been to be able to 3D print integrated objects where enclosures, shapes, and functional elements such as electronics, power, storage, and optics are all printed in one step. An example of such an effort is Printed Optics, which uses the Objet Eden260V multi-material printer to integrate custom optical elements, such as light pipe bundles, into passive 3D printed objects. When combined with some minimal electrical components, it allows for the designing of novel interactive display and input devices that are not possible or feasible using any other current fabrication technology. There have not been any attempts to investigate the fabrication of 3D printed loudspeakers.

With the advent of multi-material 3D printers, e.g., that are capable of printing with 3D print conductive ink and polymers, an entire free-form electrostatic speaker may be produced, as described herein. Additionally or as an alternative, manual steps may be included in forming various free-form electrostatic speaker components. For example, the conductive layers of various example implementations described herein may be sprayed or painted using commodity conductive spray paints. However, the fundamental principles that are outlined herein are general and are not contingent on the particular materials or technology on-hand or even the limitations of materials and technology currently available. For example, while relatively scarce, in the near future 3D printers capable of printing with conductive materials may become commonplace, and printing functional speakers embedded into objects with minimal human involvement may become more commonplace.

Electrostatic Sound Production

Referring to FIG. 1(A-B), the basic principles of electrostatic sound production were explored in depth in the 1930s. A thin conductive diaphragm and an electrode plate are separated by insulating materials, which can include air, with the dielectric permittivity ∈, as illustrated in FIG. 1A. The audio signal is amplified to approximate 1000 V and then applied to the electrode, charging it relative to the ground level that is connected to the diaphragm. As the electrode is charging, an electrostatic attraction force is developed between the electrode and diaphragm. According to Columb's Law, this attractive force can be calculated as follows:

$$\vec{F} = \frac{q_1 q_1}{2\varepsilon S} = \frac{\varepsilon S V^2}{2d^2} \quad \text{[EQ1]}$$

where ∈ is permittivity, S is electrode surface size, d is distance, and V is a potential difference between the electrode plate and the diaphragm. This electrostatic force would deform or displace the diaphragm by Δx (FIG. 1A) and, as an alternating audio signal is provided, displace air creating an audible signal. In other words, the diaphragm is actuated with electrostatic force to create a speaker.

The quality of the sound produced by the ESR speaker depends on several parameters. According to EQ1, the larger the surface, the higher permittivity of the insulating material and smaller distance between plates, the higher the force created, with a larger displacement Δx, and therefore, a higher sound pressure level. The size of the electrode and diaphragm cannot be increased indefinitely: a thinner diaphragm produces better speaker response, therefore smaller and lighter speaker would be louder than a larger ESR device with a heavy diaphragm.

The ESR speaker forms a capacitor and, therefore, another important property that has to be considered is the electrical time constant τ, which defines how fast the induced charge builds on the other plate of the capacitor:

$$\tau = C \cdot R = \frac{\varepsilon S R}{d} \quad \text{[EQ2]}$$

where R is the input impedance of the speaker. A larger τ would degrade speaker response at higher frequencies and the speaker design; therefore, it is a question of tradeoffs between loudness and the frequency response.

Figure 1B:
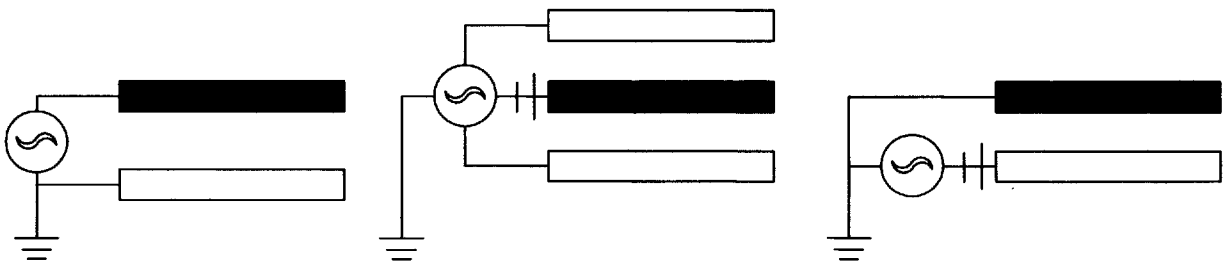
FIG. 1B illustrates example configurations for an electrostatic speaker.

The ESR devices of an embodiment described has a ground connected to the diaphragm, and the audio signal is injected into the electrode, as illustrated in the rightmost configuration of FIG. 1B, contrary to the design of the ESR speakers reported in the past where the signal would be connected to the diaphragm or three electrode configurations were used, as illustrated in the leftmost and middle configurations of FIG. 1B. Although in designing normal home audio speakers the choice may be irrelevant, it becomes important in speakers that can be embedded in toys and other 3D objects that can be touched by the user. The grounded diaphragm protects the user touching the speaker any from high voltage (audio source), making it safe to handle and manipulate. This becomes particularly important when free-form electrostatic speakers are utilized in interactive applications, as further described herein.

3D Printed Free-Form Electrostatic Speakers

Figure 2:
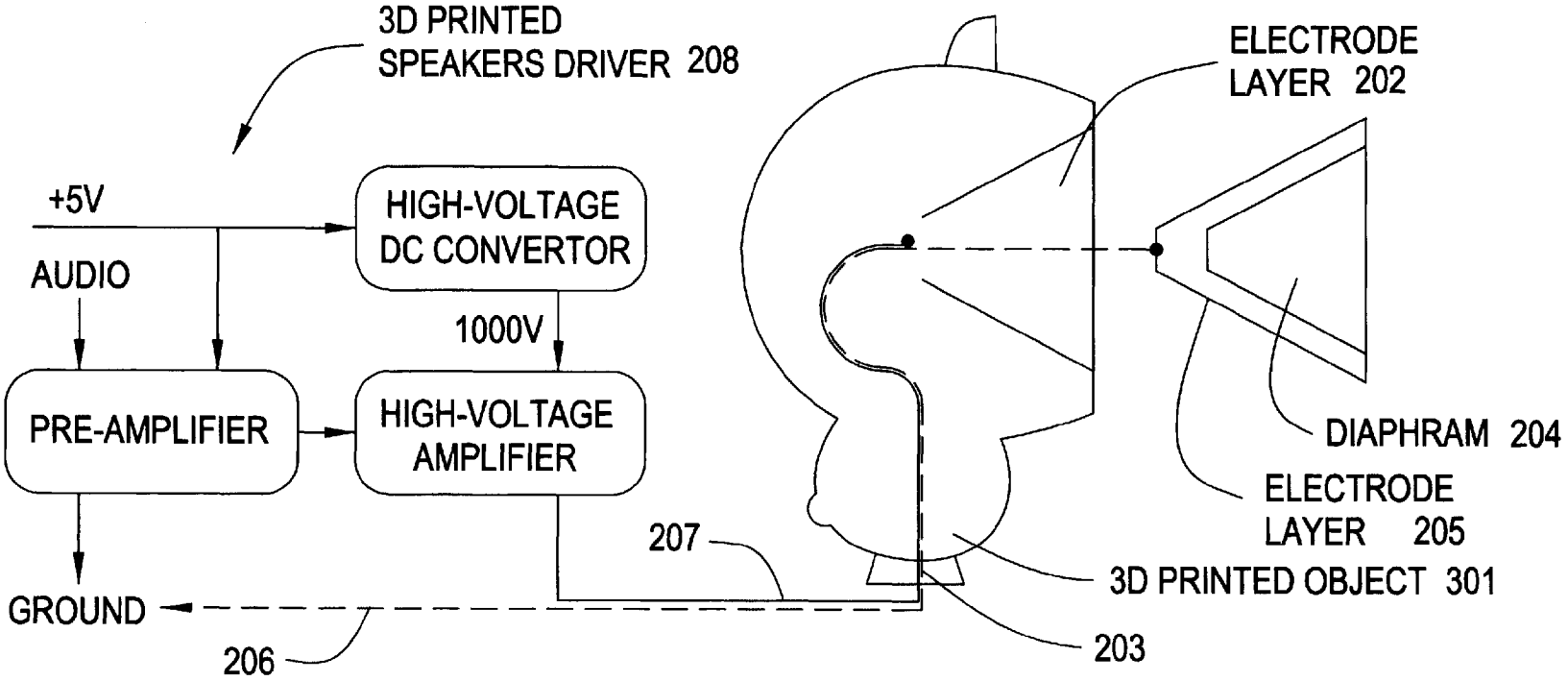
FIG. 2 illustrates an example free form electrostatic speaker and related components.

The overall design of 3D printed free-form electrostatic speakers is presented in FIG. 2 using the example of a toy character with an integrated free-form electrostatic speaker. The body 201 of the toy may be 3D printed using currently available 3D printing technology. For example, an Objet260 3D printer with single material printing head that is not capable of printing conductive materials may be used. In such a case, the process may be supplemented by painting conductive areas or layers, e.g., with Nickel-based conductive spray paint (such as MG CHEMICALS SUPER SHIELD Nickel conductive coating). Painting conductive layers is a straightforward procedure; however, it will be unnecessary if printing heads capable of printing conductive materials are available. Thus, the painting process may be eliminated altogether but is included herewith as this may be the only option currently available to many users.

A conductive layer 202 is disposed on (e.g., printed or painted on) the body 201 of the toy and becomes an inner electrode layer where the audio signal is injected, e.g., at a suitable connection element 203. The sound-producing diaphragm 204, which again may be 3D printed, has a conductive layer 205 disposed thereon as well, e.g., painted on. In addition, the diaphragm 204 in this implementation will form an outer surface of the object 201, thus the diaphragm 204 is also coated with an insulating layer (not shown), e.g., a silicone-based coating spray (such as TECHSPRAY 2102-12S silicone spray). The insulating layer increases the insulation between the electrode 202 and sound-making diaphragm 204. The diaphragm 204 may then inserted into the toy body 201 and held in place using a suitable connector, e.g., a 3D-printed connector ring. The diaphragm 204 and painted electrode 202 are then connected to both ground 206 and audio outputs 207 of the audio driver 208. That is, in an embodiment, the speaker receives inputs from an external source.

An example audio driver 208 for a free-form electrostatic speaker amplifies the input audio signal from nominal amplitude (e.g., ~1.0 V peak-to-peak) to high voltage 1000V peak-to-peak signal by using a high voltage transistor amplification circuit. A miniature voltage step-up converter (e.g., EMCO QH10-5 or QH04-5) boosts voltage from 5 V DC to 1000 V DC, which then is used as a high-voltage source for the transistor amplifier. The output current of the voltage converter and therefore audio driver 208 is ~1.25 mA. The entire example driver 208 used in various prototype implementations runs at 5 V DC and consumes 250 mA maximum current.

The air electrical breakdown can occur between electrical contacts when the potential has a large difference. Therefore, an appropriate distance (e.g., >1 mm) is maintained between all high-voltage traces and connectors on the controller board. In addition, silicone-based insulator spray can be used to improve the isolation between the contacts.

The implemented printed speaker system of FIG. 2 is presented by way of example. Such an implementation may run from either a standard Li-Ion battery or USB connection and accepts any standard audio input, such as from a mobile phone.

Free-Form Electrostatic Speaker Design Space

Figure 3:
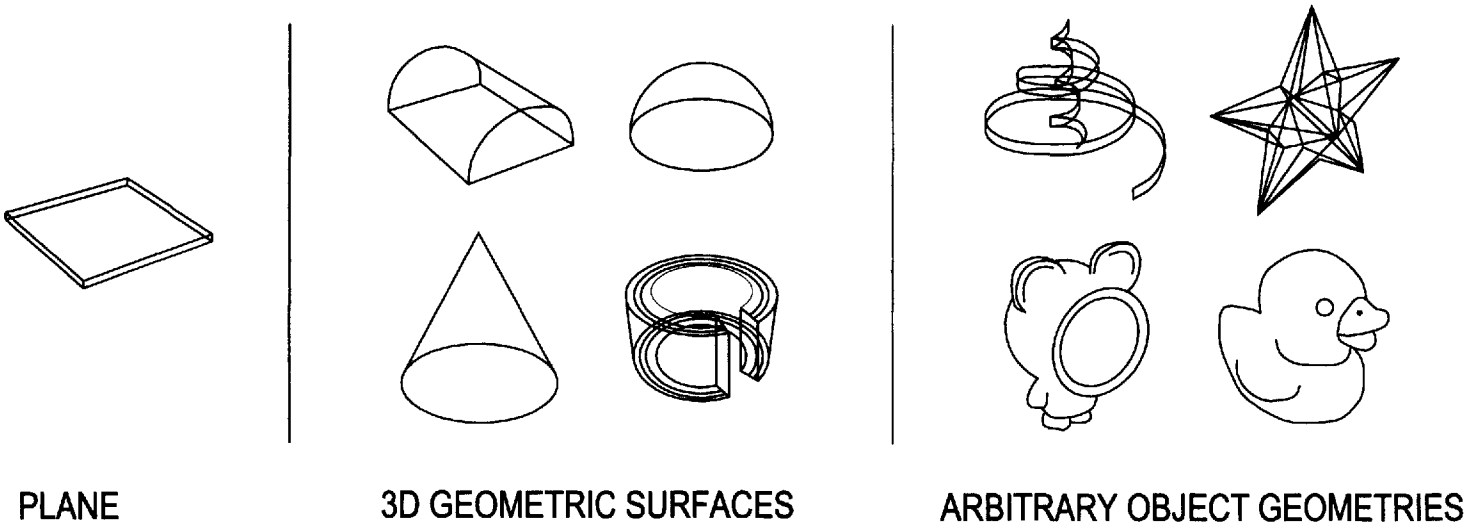
FIG. 3 illustrates example arbitrary shapes for a free-form electrostatic speaker.

Free-form electrostatic speakers, e.g., 3D printed free-form electrostatic speakers, may take any form and shape leading to a variety of unique applications. FIG. 3 illustrates some of the free-form electrostatic speaker variations that become possible according to embodiments, particularly when paired with 3D printing technology. Traditional flat planer speakers (FIG. 3, leftmost panel) while possible for use, do not constitute a "free-form" speaker and thus this planar category of speaker is not considered further herein.

At the next level of complexity, speakers can take a variety of basic 3D geometrical shapes including traditional cone-shaped speaker, cylindrical, spherical and others (FIG. 3, middle panel). All these 3D shapes allow produced sound to be distributed in multiple directions around the free-form electrostatic speaker, i.e., omni-directional sound may be produced, as described further herein. Note that designing 3D geometrical speakers using traditional speaker technologies is a very challenging problem. Using a free-form electrostatic speaker approach, designing various geometrically shaped speakers becomes straightforward.

A challenging aspect of 3D speaker technology is the speaker is to be integrated into objects of arbitrary shape, becoming an unobtrusive and invisible part of the object's design. 3D printed free-form speakers provide an alternative to traditional techniques of integrating loudspeaker functionality into arbitrarily shaped objects and devices, such as those illustrated in FIG. 3 (rightmost panel), where speakers take on arbitrary shapes, turning these arbitrary shapes into the speaker itself. In some embodiments, as further described herein, only certain elements of an object have speaker functionality, and in other embodiments, the entire body of the object generates sound (audible or otherwise).

Diaphragm for Free-Form Electrostatic Speakers

Validation of the example implementations of 3D printed free-form electrostatic speakers was conducted to evaluate their sound reproduction performance as well as to understand the design variables affecting it. A factor influencing the quality of 3D printed free-form electrostatic speakers' sound is the design of the diaphragm.

Figure 4:
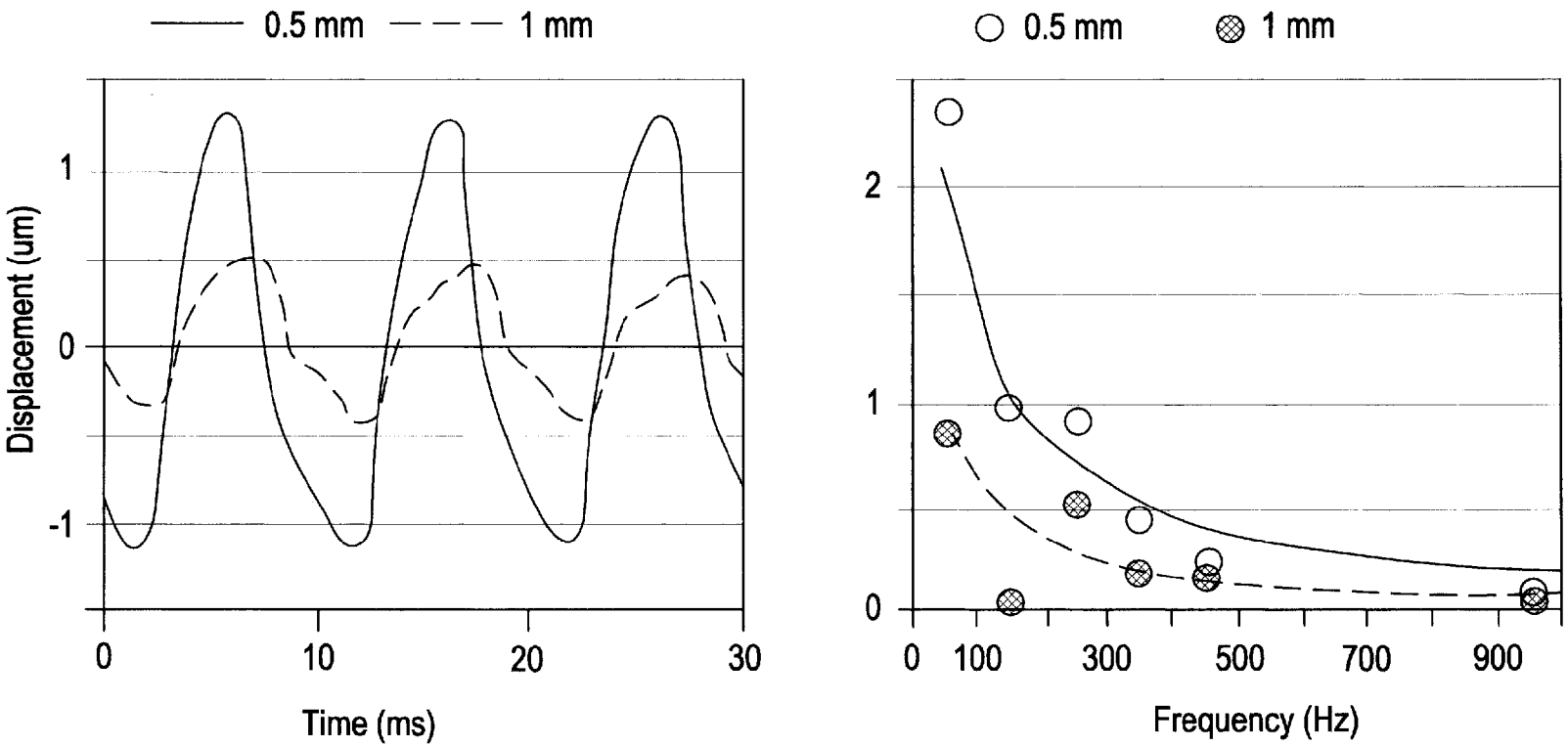
FIG. 4 illustrates example displacements of three dimensional (3D) printed diaphragms of varying thickness.

FIG. 4 illustrates the results of the measurements of the displacement of two example 3D printed diaphragms with the thicknesses of 1.0 mm and 0.5 mm, weighing 3.65 g and 5.94 g, respectively, driven by a 100 Hz sinusoid signal. The KEYENCE LK-H057 laser displacement sensor was used to measure the movement of the diaphragm at a 20 kHz sampling rate with 0.025 μm accuracy. In addition to displacement, the EXTECH 407730 sound level meter was used to measure sound pressure levels (SPL), settled at a place that is 30 cm away from the 3D printed speaker.

The validation experiments demonstrate that a) 3D printed free-form electrostatic speakers work as designed, and b) lighter and thinner diaphragms produce significantly larger displacement and therefore louder sounds. In fact, the displacement nearly doubled when the thickness of the diaphragm was decreased by half. The emitted energy increases with the increase of the displacement, which was supported by the measurements that resulted with 54.8 dBSPL and 53.2 dBSPL for 0.5 mm and 1.0 mm diaphragms using 2 kHz input signal.

The latter observation was surprising. As diaphragms become thinner, they also become softer and much more flexible. It was not clear a priori that thinner, yet much softer and more flexible diaphragms, would outperform slightly thicker and stiffer ones. The experiments demonstrated that the stiffness of a diaphragm is not as important as its thickness and weight. This finding allowed significant expansion of the range of materials and processes that could be used to create effective diaphragms for 3D printed free-form electrostatic speakers.

Directionality and Geometry of Free-Form Electrostatic Speakers

An exciting property of free-form electrostatic speakers is that they permit turning virtually any surface of an object into a sound producing surface. In particular, it allows for controlling the sound directionality and it is relatively trivial to design free-form electrostatic speakers that have either highly directive or, adversely, omni-directional sound using the free-form electrostatic speakers described herein. This is a unique property of ESR speaker technology that is facilitated by the availability of 3D printing technology.

Typically, designing highly directive or omni-directional speakers is a challenging problem. It usually requires designing speaker arrays that have to be individually controlled and calibrated, both of which are expensive and labor intensive. In case of free-form electrostatic speakers, e.g., a 3D printed free-form electrostatic speaker, the entire surface contributes to sound production and, as sound direction is normal to the diaphragm geometry, the directionality of sound is simply a function of the object's surface geometry.

To illustrate this, referring to FIG. 5(A-D), four speaker shapes were designed, including classic speaker cone, half cylinder, full cylinder and a slit speaker, where the vibrating diaphragm is inside. The diaphragm area for all speakers was kept constant at 5625 $mm^2$. Common aluminum metalized polyester film was used for all diaphragms. The metalized polyester offers an inexpensive and easy-to-use alternative to 3D printed diaphragms for simple geometrical shapes because it is light, durable, thin (~0.127 mm) and easily accessible.

Figure 6:
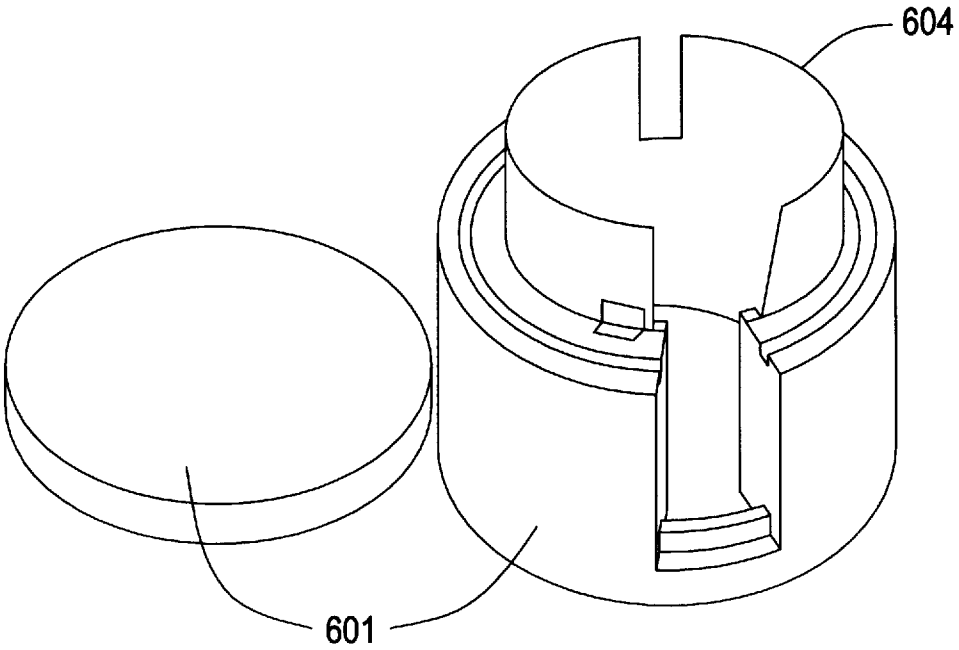
FIG. 6 illustrates an example slit 3D printed electrostatic speaker.

The directionality of each 3D printed free-form electrostatic speaker was evaluated using input signal frequencies at 2 kHz and 10 kHz. FIG. 6(A-D) illustrates the results of the measurement of sound pressure levels at different angles for each of these example free-form electrostatic speakers. The graph is normalized in relation to the sound pressure levels at 0 degrees and plotted with a 22.5° interval.

The results of the measurement demonstrate that sound directionality is indeed defined by the surface geometry of the 3D printed free-form electrostatic speaker: each point of the diaphragm emits sound in an approximately normal direction, as is expected. The directionality is stronger at higher frequencies, which is expected. For a free-form cylindrical speaker, the sound distribution was nearly perfectly uniform (FIG. 6D), making this geometry an excellent and very inexpensive omni-directional speaker.

Figure 5A:
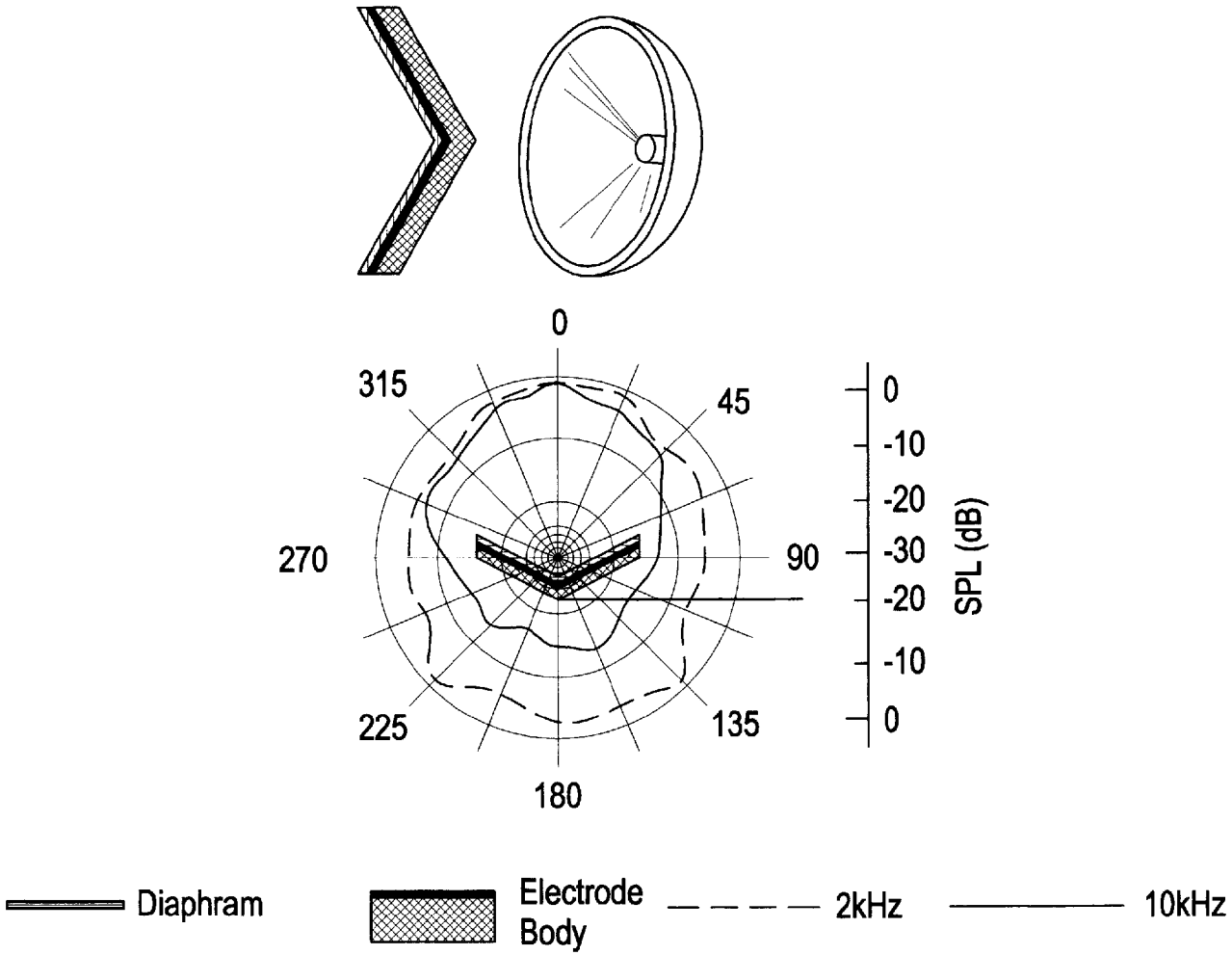
FIG. 5(A-D) illustrates example geometries and sound directionality for various diaphragm types of 3D printed free-form electrostatic speakers.
Figure 5B:
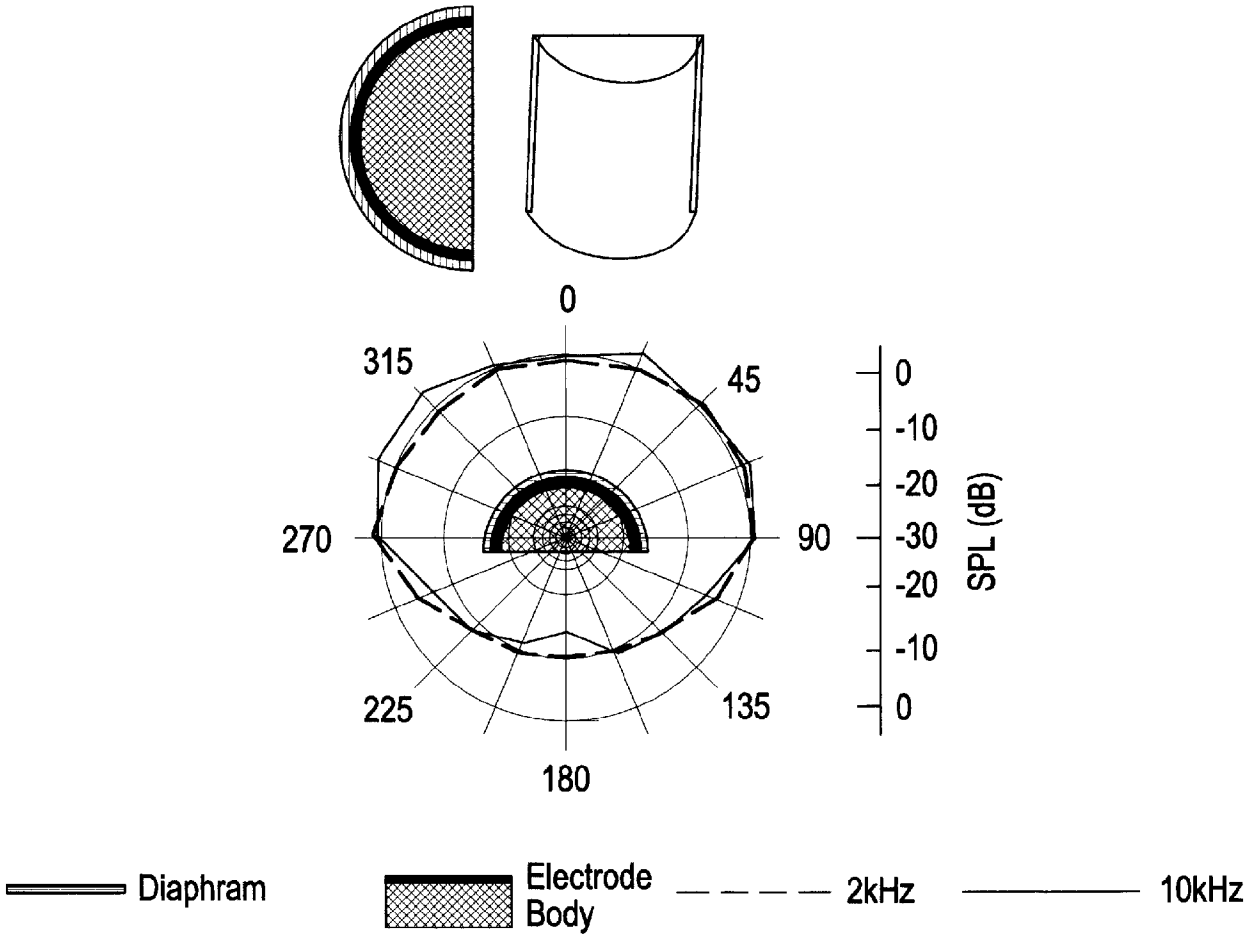
Figure 5C:
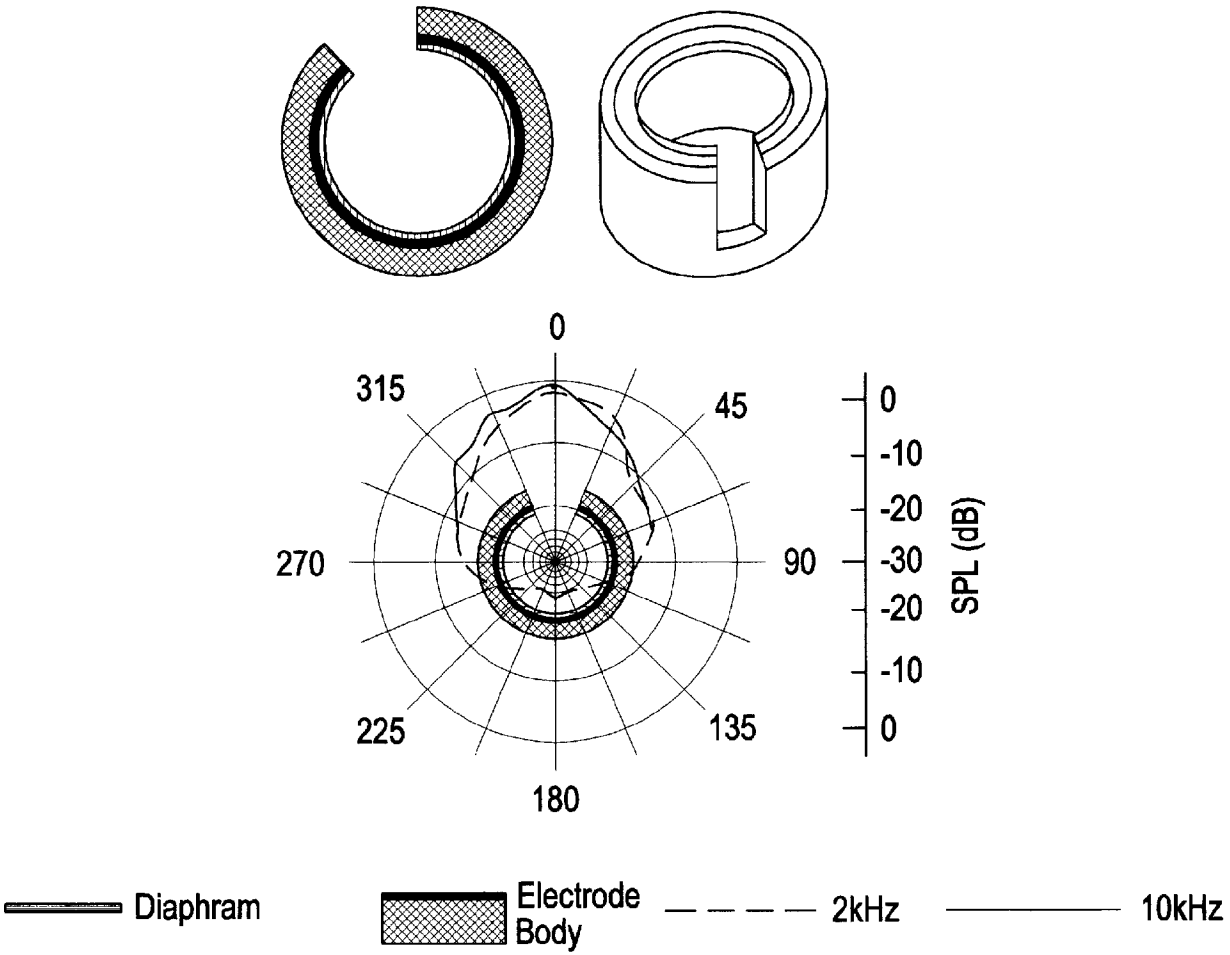
Figure 5D:
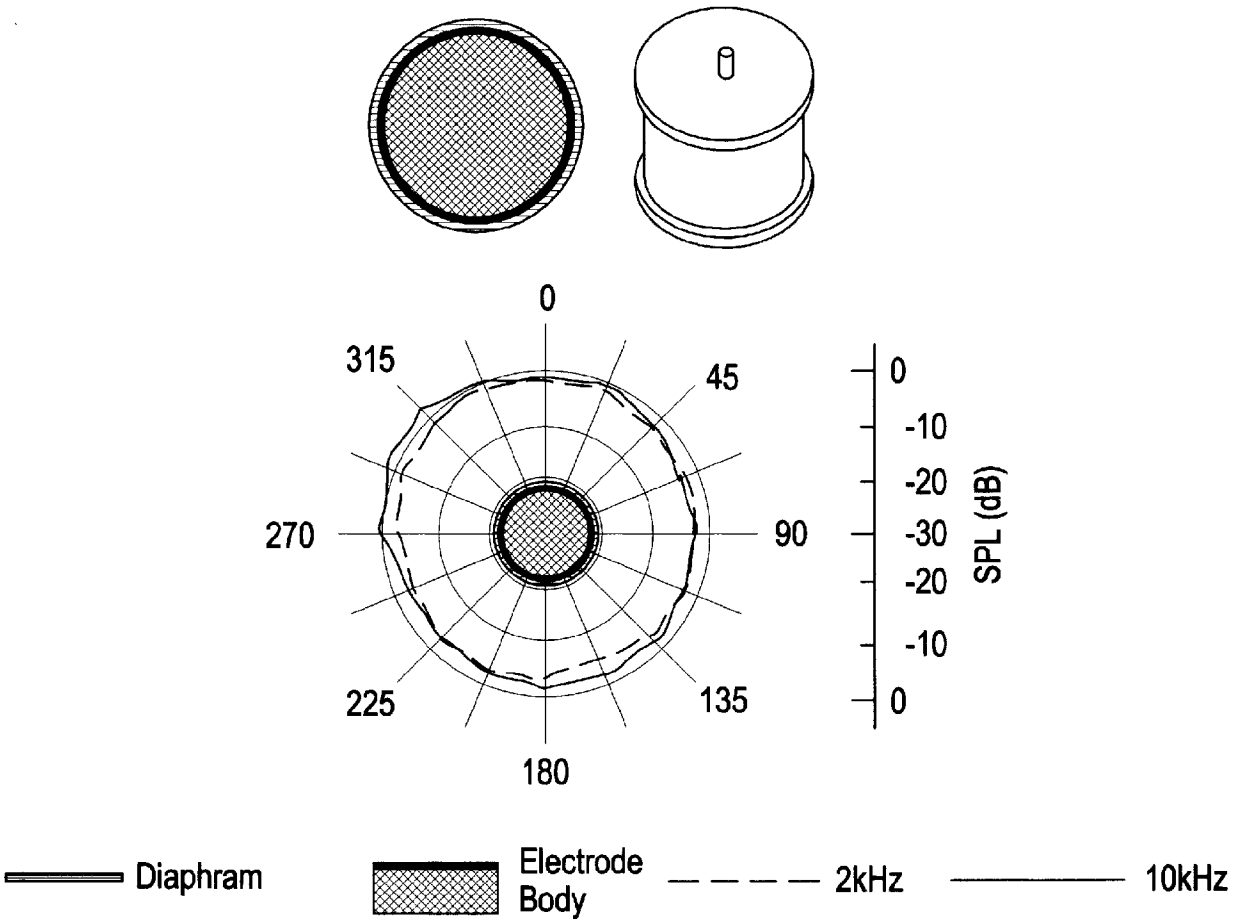

The slit free-form electrostatic speaker is a configuration with the internal diaphragm 604 placed inside of the cylindrical object 601, as illustrated in FIG. 6, which allows for the production of highly directional sound. As illustrated in FIG. 5C, sound pressure levels in 90°-270° diapason was not measurable for a 10 kHz signal because the sound pressure levels were below the sensitivity thresholds of the SPL measurement equipment used. The slit free-form electrostatic speaker provides a very useful configuration where the speaker is to be placed inside of the object. For example, it can be placed inside of a toy character with a mouth opening, which would create the impression that the sound is coming directly from the character's mouth, increasing both realism and engagement. Furthermore, the slit design provides protection from the speaker's electrical circuitry for the user.

Electrode Arrays in Free-Form Electrostatic Speakers

Free-form electrostatic speakers can be implemented with any electrode configuration depending on the application's requirements and the type of objects being embedded with the speakers. In case of electrode arrays, each electrode would be acting as an independent free-form electrostatic speaker, even though all of them may be sharing a single diaphragm.

Figure 7B:
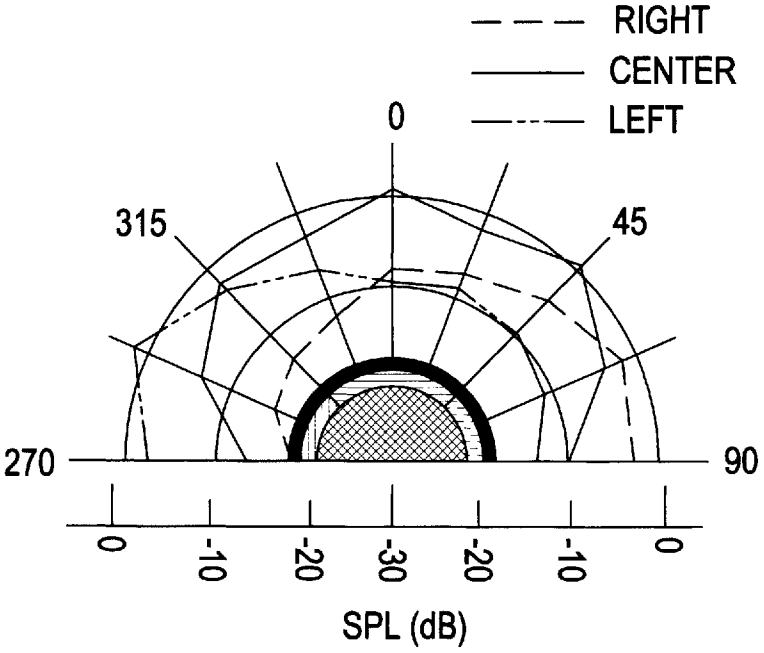
FIG. 7(A-B) illustrates an example multi-electrode 3D printed electrostatic speaker and sound production thereof.
Figure 7A:
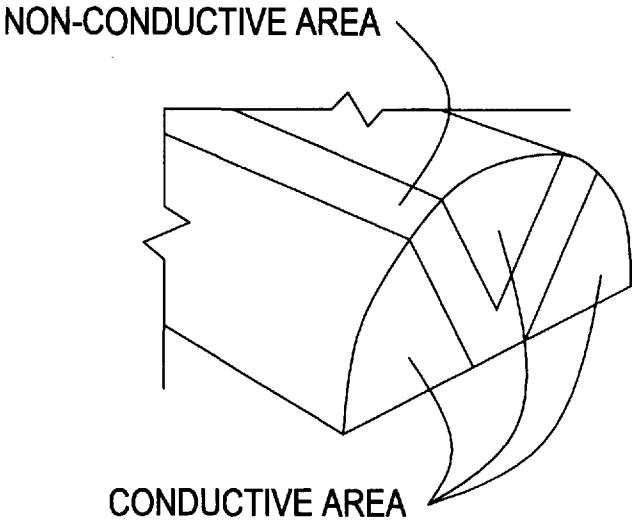

To test electrode arrays configuration, sound pressure level distributions were measured for a half cylindrical free-form electrostatic speaker with a painted electrode array, illustrated in FIG. 7A. Three electrodes were painted at 20°-90°, 30°-330° and 340°-270° degrees (FIG. 7B), and a single metalized polyester diaphragm was used as in previous experiments (e.g., as illustrated in FIG. 5B). FIG. 7B illustrates the results of measurement with 2 kHz used with each electrode. It may be observed that each speaker produces directive sound output in its respective direction. When actuated simultaneously with different signal frequencies, the same distribution was observed for individual frequencies.

The results of these experiments demonstrate the versatility of free-form electrostatic speaker technology. A single object can have multiple electrodes sharing the same diaphragm and yet acting as individual speakers, with individual and directive sound output. Location-based audio displays both on a small-object scale and on the scale of an entire environment can be easily designed and produced with free-form electrostatic speaker technology.

Integrating Free-Form Electrostatic Speakers into Objects

An opportunity provided by free-form electrostatic speakers is the ability to integrate loudspeaker functionality into objects at the design stage. Although some implementations may require a certain amount of hand assembly, depending on equipment and material availability, free-form electrostatic speakers may be integrated into objects and devices at design time, e.g., as one of the elements of a CAD program.

A straightforward way to integrate free-form electrostatic speaker functionality into an object is to simply place one of the basic geometrical speakers described herein into the appropriate place in the object. As an example of this approach a toy bear with a speaker embedded within the head was created, as outlined in FIG. 2. Such integration is straightforward and any of the free-form electrostatic speaker shapes presented herein may be utilized, i.e., the free-form electrostatic speaker can be embedded inside objects.

An alternative approach to embedding the free-form electrostatic speaker within the object is to enhance the physical body of the object with loudspeaker functionality. That is, in an embodiment, the entire object's surface or any part of it becomes the speaker, seamlessly and invisible to the user.

Figure 8B:
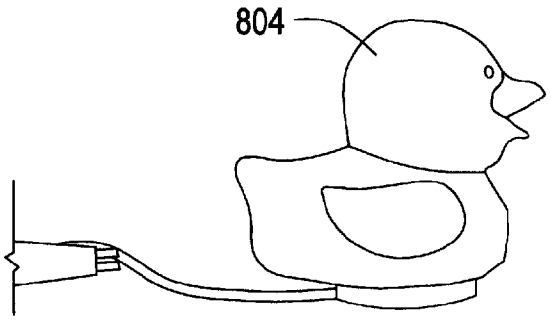
FIG. 8(A-B) illustrates arbitrary shapes for free-form electrostatic speakers having a thin-film diaphragm.
FIG. 8C illustrates an example of a molded thin-film diaphragm.
Figure 8A:
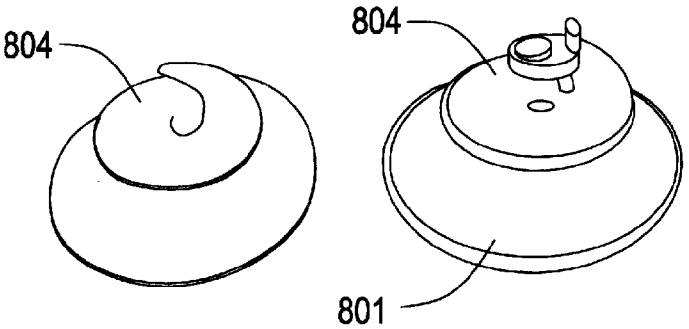

In a simplest approach, only the parts of the object surface that can be easily augmented with diaphragms, which may be 3D printed and attached, are used in turning the object into the speaker. FIG. 8A illustrates a spiral free-form electrostatic speaker created using such an approach. The diaphragm 804 is shown on the left and was a 3D printed surface of the spiral. On the right of FIG. 8A is illustrated an assembled free-form electrostatic speaker where the diaphragm 804 is attached on the 3D printed spiral body 801, in this example using a soft silicon compound. Similarly, any other object that has any number of amenable surface(s), e.g., flat faces, may be easily turned into a free-form electrostatic speaker. Thus, toys, decorations, household items and many other objects may be augmented with loudspeaker functionality.

Another approach to augment objects with loudspeaker functionality is turning the entire body of the object into a speaker by covering the object with the diaphragm. FIG. 8B demonstrates a duck free-form electrostatic speaker where the entire 3D printed duck toy body is wrapped in a compliant diaphragm 804, creating one single sound-emitting outer surface.

A challenge in designing full body object speakers is creating a diaphragm that is thin, robust and covers the entire body of the object. The experimental evaluation described herein has demonstrated that thinner and softer the minimum thickness of 3D printed diaphragm using the specific 3D printer is limited to ~0.3 mm and a larger diaphragm for encompassing substantially the entire object is relatively heavy, reducing sound levels.

Figure 8C:
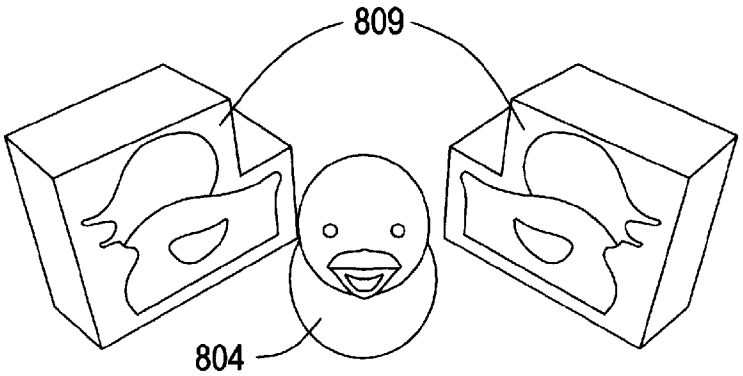
Figure 9:
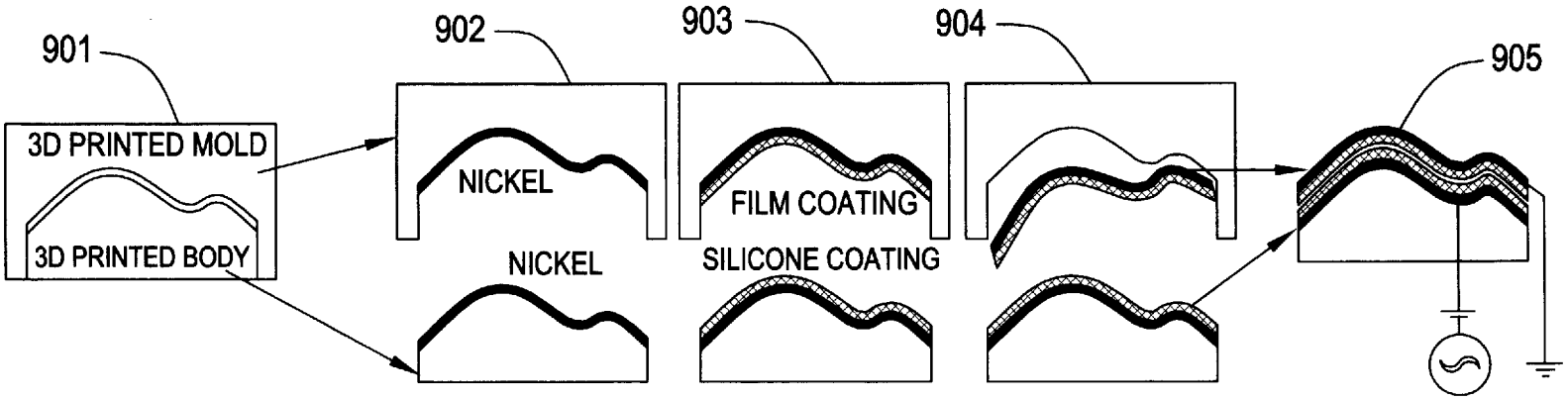
FIG. 9 illustrates an example fabrication process for a thin-film diaphragm free-form electrostatic speaker.

In order to create thin reliable full body diaphragms, a fabrication procedure that uses film coatings and 3D printed molds creates object-compliant diaphragms that are ~0.14 mm thin and weighing 1.1 grams. FIG. 9 illustrates an outline of an example fabrication process. First, a negative mold (e.g., 809 of FIG. 8C) is created at 901, e.g., via 3D printing using the same CAD model as an object (e.g., a duck as illustrated in FIG. 8C). Then both the mold and the object have applied thereto a conductive layer at 902, e.g., both may be sprayed with a nickel-based conductive paint. The mold is then coated at 903 with a thin layer of insulation, e.g., polyethylene coating spray (such as 3M PAINT DEFENDER spray film), forming a thin soft film bonded to the nickel-based paint.

If a polyethylene coating spray is used, additional insulation may be appropriate for high-voltage applications. Therefore, the object body may be coated with a silicone-based insulation spray at 904, e.g., over a nickel-based paint layer. The molds may be fast dried in an oven and the formed film thereafter removed from the mold at 905. The resulting film is strong, conductive, and thin. The film mirrors the shape of the object. It then may be used as a diaphragm to cover the entire body of the object, effectively turning it into an omni-directional free-form electrostatic speaker.

Interactive Uses of Free-Form Electrostatic Speakers

The basic functionality for free-form electrostatic speakers as described herein is to produce an effective sound. The free-form electrostatic speakers may be utilized as effective loudspeakers, particularly at higher and mid frequencies. In addition, however, the free-form electrostatic speakers also may provide a range of interactive functionality.

Ultrasonic Tracking and Identification

Figure 10A:
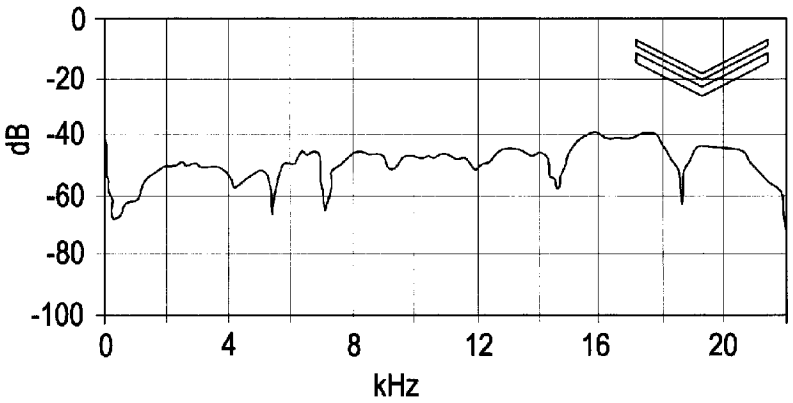
FIG. 10(A-B) illustrates example frequency responses of a 3D printed free-form electrostatic speaker and uses thereof for interactive functionality.

FIG. 10A illustrates the frequency response of cone-shaped 3D printed free-form electrostatic speakers over a range of frequencies. The figure demonstrates that 3D printed free-form electrostatic speakers can effectively reproduce sound over 20 kHz, i.e., in ultrasonic frequencies. Thus, the free-form electrostatic speaker objects can both output audible sound and at the same time produce signals at ultrasonic frequencies that can be used for various interactive functions, e.g., lightweight data communication and object tracking.

Figure 10B:
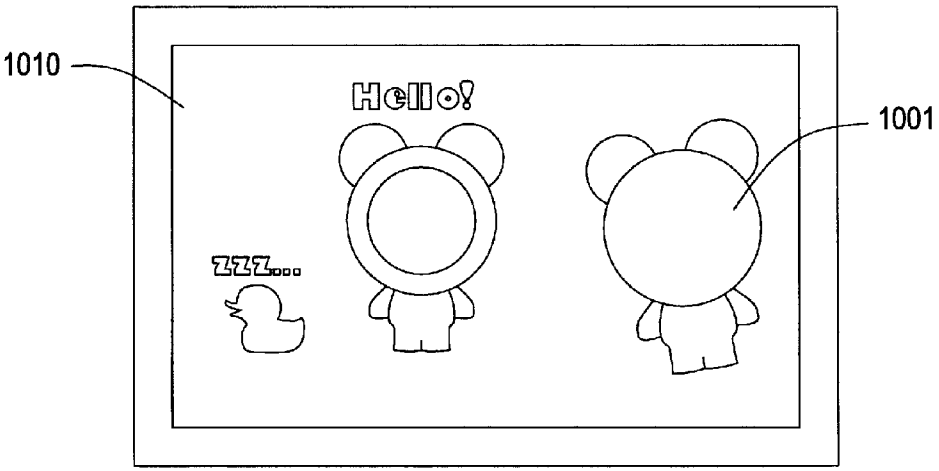

FIG. 10B illustrates an example of simple interactive applications that may be developed using free-form electrostatic speakers. In FIG. 10B, a 3D printed bear toy 1101 both outputs audible messages and, at the same time, communicates inaudible signal patterns in the ultrasonic range.

Using a standard microphone embedded in a desktop computer, an application running on the computer identified the object 1001 that the user was holding, tracked the distance between object 1001 and the display 1010 with ~10 cm accuracy, as well as identified and recognized the motion patterns of the object 1001 as well as simple gestures. For example, the system can recognize that the object 1001 has been brought closer to the display 1010, or taken further away, and reply accordingly. At the same time, the object 1001 that is attached to the audio output of the same desktop computer also responds to the interactions that the user is performing by playing audio messages.

This non-limiting example demonstrates how various interaction scenarios, e.g., games and educational applications may be easily designed and implemented using free-form electrostatic speakers. Ultrasound tracking can also be used with mobile phones and tablets, allowing for mobile applications. No special or additional devices are required. Note that ultrasound tracking functionality comes for "free", i.e., no additional devices, embedded electronics or modifications to the free-form electrostatic speaker are required. Special and/or additional devices may be utilized if desired. For example, by using a stereo microphone or a microphone array, the location of the object 1101 may be measured more accurately.

Touchable and Tactile Feedback

The free-form electrostatic speakers may be touched and held by users and still function effectively as a speaker. In the case of the ESR speakers, the diaphragm covers large areas of the object and the entire diaphragm participates in creating sound. Therefore, parts of the thin, elastic diaphragm 1104 will still function as a speaker even though the user is touching and holding other parts of it, as illustrated in FIG. 11A.

Figure 11B:
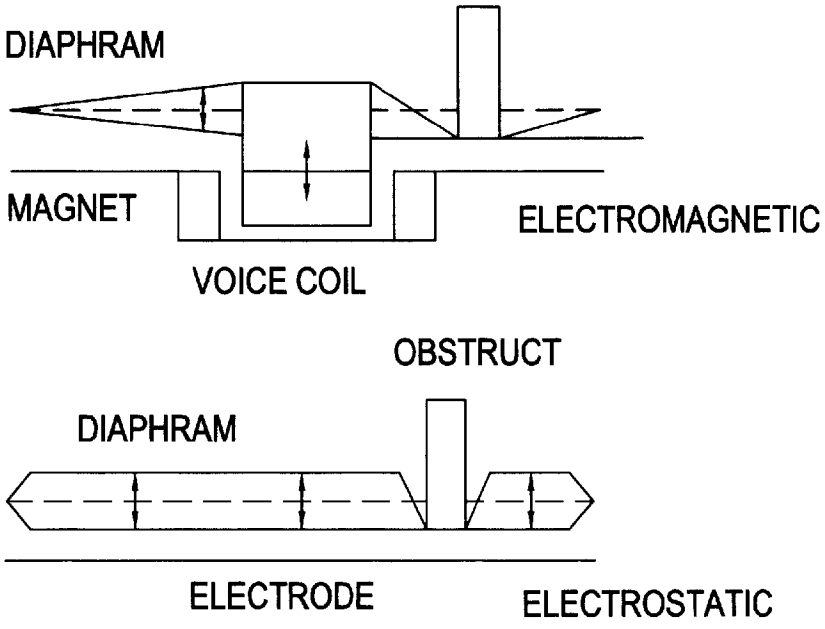
FIG. 11(A-B) illustrates tactile feedback of an example 3D printed free-form electrostatic speaker.
Figure 11A:
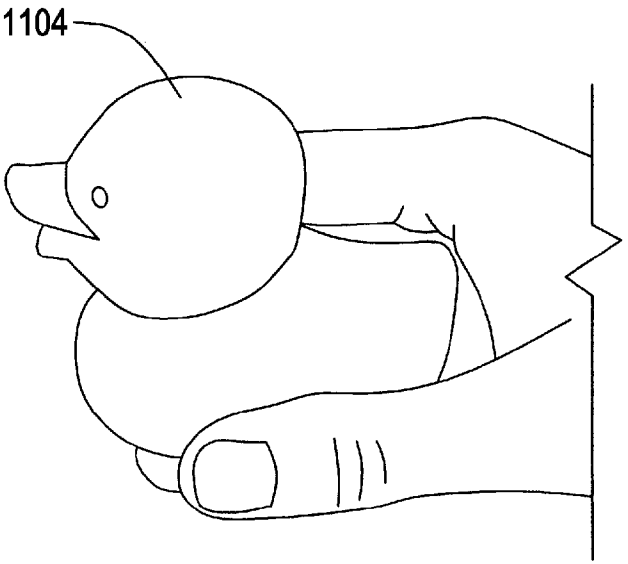

This property of ESR printed speakers is quite unique and the same does not hold true for traditional electromagnetic loudspeakers that consist of voice coil and magnets, as illustrated in FIG. 11B. In electromagnetic speakers only the voice coil vibrates and other speaker parts are passive, transferring and amplifying these vibration forces. Therefore, touching the diaphragm of electromagnetic speaker anywhere would significantly impede its operation.

The fact that free-form electrostatic speakers can be touched and held in a user's hands means that they may be used to communicate tactile feedback to the user. In an initial investigation of these properties, for example, it was established that the user can clearly feel bursts of signals at 20~120 Hz frequency.

Functionality of embodiments may be implemented using a variety of apparatuses or devices, e.g., a desktop computer, a laptop computer, a smart phone, etc. For example, a desktop computer has been used in an example implementation with respect to an embodiment providing interactivity. Such a computing device may take the form of a device including the example components outlined in FIG. 12.

Figure 12:
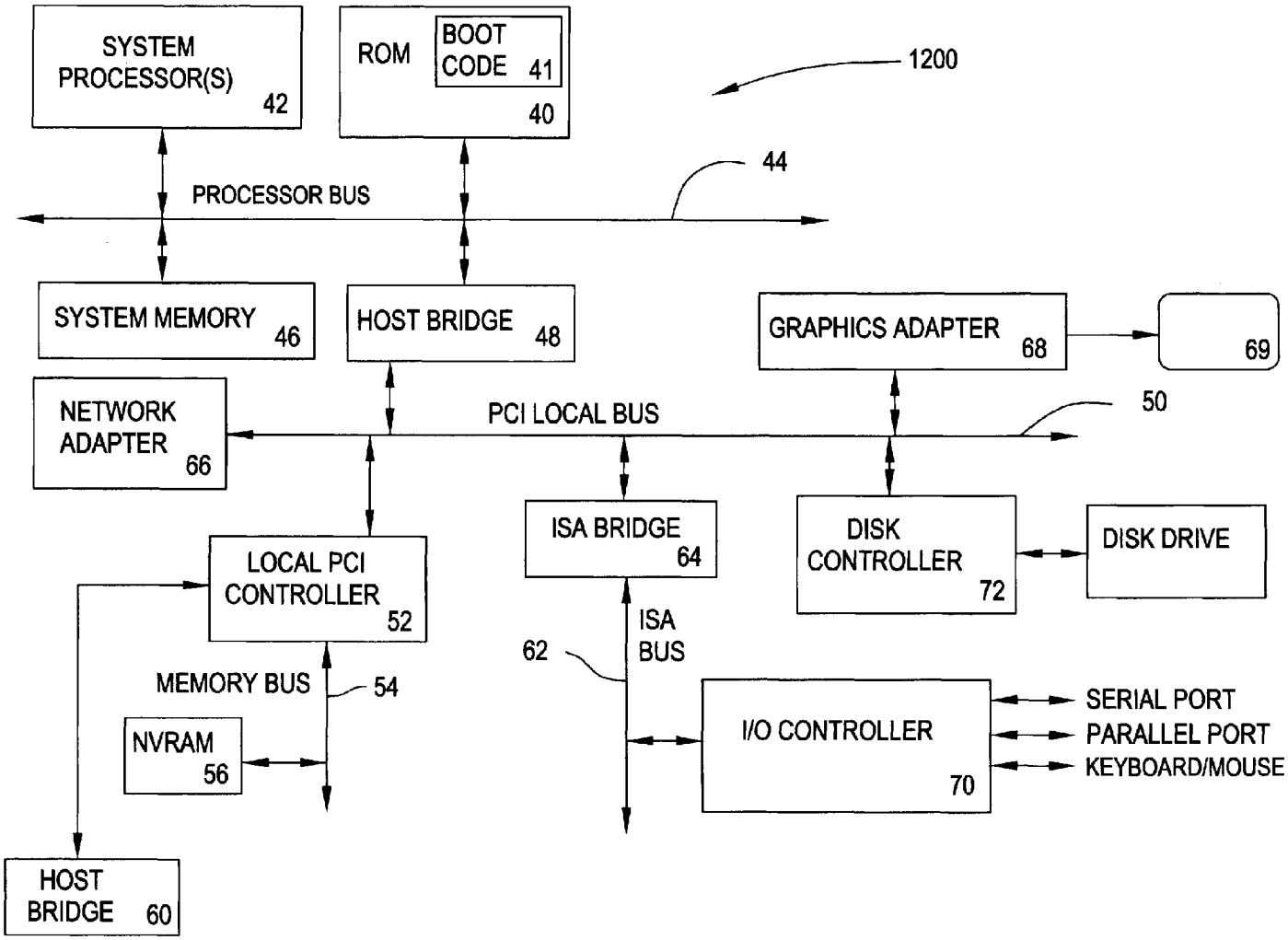
FIG. 12 illustrates an example of device circuitry.

In FIG. 12, there is depicted a block diagram of an illustrative embodiment of a computer system 1200. The illustrative embodiment depicted in FIG. 12 may be an electronic device such as workstation computer, a desktop or laptop computer, or another type of computing device used to process data such as transmitted or received audio data. As is apparent from the description, however, various embodiments may be implemented in any appropriately configured electronic device or computing system, as described herein.

As shown in FIG. 12, computer system 1200 includes at least one system processor 42, which is coupled to a Read-Only Memory (ROM) 40 and a system memory 46 by a processor bus 44. System processor 42, which may comprise one of the AMD line of processors produced by AMD Corporation or a processor produced by INTEL Corporation, is a processor that executes boot code 41 stored within ROM 40 at power-on and thereafter processes data under the control of an operating system and application software stored in system memory 46, e.g., an application for aligning media types, as described herein. System processor 42 is coupled via processor bus 44 and host bridge 48 to Peripheral Component Interconnect (PCI) local bus 50.

PCI local bus 50 supports the attachment of a number of devices, including adapters and bridges. Among these devices is network adapter 66, which interfaces computer system 1200 to LAN, and graphics adapter 68, which interfaces computer system 1200 to display 69. Communication on PCI local bus 50 is governed by local PCI controller 52, which is in turn coupled to non-volatile random access memory (NVRAM) 56 via memory bus 54. Local PCI controller 52 can be coupled to additional buses and devices via a second host bridge 60.

Computer system 1200 further includes Industry Standard Architecture (ISA) bus 62, which is coupled to PCI local bus 50 by ISA bridge 64. Coupled to ISA bus 62 is an input/output (I/O) controller 70, which controls communication between computer system 1200 and peripheral devices such as a as a keyboard, mouse, serial and parallel ports, etc. A disk controller 72 connects a disk drive with PCI local bus 50. The USB Bus and USB Controller (not shown) are part of the Local PCI controller (52).

In addition to or as an alternative to the device or apparatus circuitry outlined above, as will be appreciated by one skilled in the art, various aspects of the embodiments described herein may be carried out using a system of another type, may be implemented as a device-based method or may embodied at least in part in a program product. Accordingly, aspects may take the form of an entirely hardware embodiment or an embodiment including software that may all generally be referred to herein as a "circuit," "module" or "system."

Furthermore, an embodiment may take the form of a program product embodied in one or more device readable medium(s) having device readable program code embodied therewith.

Any combination of one or more non-signal/non-transitory device readable storage medium(s) may be utilized. The storage medium may be a storage device including program code.

Program code embodied on a storage device may be transmitted using any appropriate medium, including but not limited to wireless, wireline, optical fiber cable, RF, etc., or any suitable combination of the foregoing.

Program code ("code") for carrying out operations may be written in any combination of one or more programming languages. The code may execute entirely on a single device, partly on a single device, as a stand-alone software package, partly on single device and partly on another device, or entirely on the other device. In some cases, the devices may be connected through any type of connection or network (wired or wireless), including a local area network (LAN) or a wide area network (WAN), or the connection may be made through other devices (for example, through the Internet using an Internet Service Provider) or through a hard wire connection, such as over a USB connection.

It will be understood that the actions and functionality illustrated or described may be implemented at least in part by program instructions or code. These program instructions or code may be provided to a processor of a device to produce a machine, such that the instructions or code, which execute via a processor of the device, implement the functions/acts specified.

The program instructions or code may also be stored in a storage device that can direct a device to function in a particular manner, such that the instructions or code stored in a device readable medium produce an article of manufacture including instructions which implement the functions/acts specified.

The program instructions or code may also be loaded onto a device to cause a series of operational steps to be performed on the device to produce a device implemented or device-based process or method such that the instructions or code which execute on the device provide processes/methods for implementing the functions/acts specified.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

Although illustrative embodiments have been described herein, it is to be understood that the embodiments are not limited to those precise embodiments, and that various other changes and modifications may be affected therein by one skilled in the art without departing from the scope or spirit of the disclosure.

What is claimed is:

1. A free-form electrostatic speaker, comprising:

a three dimensional object body with at least a portion of the three dimensional object body having a free-form electrode layer disposed thereon, wherein the free-form electrode layer is shaped to substantially match the portion of the three dimensional object body;

a free-form diaphragm positioned proximate to, and being shaped to substantially match, the free-form electrode layer; and an input element coupled to the free-form electrode layer that is configured to accept input from an external source;

wherein the three dimensional object body is a three dimensional printed object; and wherein the free-form diaphragm is selected from the group of materials consisting of a three dimensional printed material and a conductive material sprayed onto the three dimensional object body.

2. A free-form electrostatic speaker, comprising:

a three dimensional object body with at least a portion of the three dimensional object body having a free-form electrode layer disposed thereon, wherein the free-form electrode layer is shaped to substantially match the portion of the three dimensional object body;

a free-form diaphragm positioned proximate to, and being shaped to substantially match, the free-form electrode layer; and an input element coupled to the free-form electrode layer that is configured to accept input from an external source;

wherein the free-form diaphragm is a substantially continuous layer disposed on an outer surface of the three dimensional object body; and wherein the free-form diaphragm is a conductive material sprayed onto the three dimensional object body.

3. The free-form electrostatic speaker of claim 2, further comprising an insulating layer disposed on an outer surface of the free-form diaphragm.

4. A free-form electrostatic speaker, comprising:

a three dimensional object body having a conductive layer disposed on at least a portion thereof;

a three dimensional printed diaphragm having a conductive layer disposed on at least a portion thereof;

the three dimensional printed diaphragm having an insulating layer disposed on the conductive layer;

a connecting element fixing the three dimensional printed diaphragm with respect to the conductive layer disposed on at least a portion of the three dimensional object body; and an input element coupled to the conductive layer of the three dimensional object body that accepts input from an external source.

5. The free-form electrostatic speaker of claim 4, wherein the three dimensional object body comprises a three dimensional printed object.

6. The free-form electrostatic speaker of claim 4, wherein the conductive layer disposed on at least a portion of the three dimensional object body covers substantially all of the three dimensional object body.

7. The free-form electrostatic speaker of claim 6, wherein the three dimensional printed diaphragm co-extends with the conductive layer covering substantially all of the three dimensional object body to cover substantially all of the three dimensional object body.

8. The free-form electrostatic speaker of claim 4, wherein the conductive layer disposed on at least a portion of the three dimensional object body is sprayed thereon.

9. The free-form electrostatic speaker of claim 8, wherein the conductive layer disposed on the three dimensional printed diaphragm is sprayed thereon.

10. The free-form electrostatic speaker of claim 9, wherein the insulating layer disposed on the three dimensional printed diaphragm is sprayed thereon.

11. The free-form electrostatic speaker of claim 4, wherein the input from an external source is selected from the group of inputs consisting of input producing ultra sonic speaker output and input producing audible speaker output.

* * * * *